US008006852B1

(12) United States Patent
Miceli et al.

(10) Patent No.: US 8,006,852 B1
(45) Date of Patent: Aug. 30, 2011

(54) ONE PIECE CONVERTIBLE CLOSURE AND A ONE PIECE CONVERTIBLE CLOSURE AND CONTAINER SYSTEM

(75) Inventors: David A. Miceli, Sparta, TN (US); Joseph A. Miceli, Sparta, TN (US)

(73) Assignee: Tri State Distribution, Inc., Sparta, TN (US)

( * ) Notice: Subject to any disclaimer, the term of this patent is extended or adjusted under 35 U.S.C. 154(b) by 798 days.

(21) Appl. No.: 11/943,448

(22) Filed: Nov. 20, 2007

Related U.S. Application Data

(60) Provisional application No. 60/866,458, filed on Nov. 20, 2006.

(51) Int. Cl.
*B65D 41/04* (2006.01)
*B65D 55/02* (2006.01)

(52) U.S. Cl. ..... 215/221; 215/220; 215/223; 215/330

(58) Field of Classification Search ..... 215/221, 215/217, 220, 330, 334, 216, 223
See application file for complete search history.

(56) References Cited

U.S. PATENT DOCUMENTS 3,698,584 A * 10/1972 Miller ..... 215/216
3,949,893 A * 4/1976 Uhlig ..... 215/216
4,116,351 A * 9/1978 Uhlig ..... 215/216
4,149,646 A * 4/1979 Julian ..... 215/216
4,520,938 A 6/1985 Finke
5,449,078 A 9/1995 Akers
5,579,934 A 12/1996 Buono
5,603,421 A * 2/1997 Opresco ..... 215/217
5,816,422 A * 10/1998 Roig ..... 215/209
5,836,467 A * 11/1998 Montgomery ..... 215/216
5,988,413 A * 11/1999 Nagel ..... 215/216
6,003,700 A * 12/1999 Julian et al. ..... 215/216
6,439,409 B1 * 8/2002 Dressel et al. ..... 215/228
6,926,161 B2 8/2005 Miceli et al.
7,000,789 B2 2/2006 Miceli et al.

* cited by examiner

*Primary Examiner* — Mickey Yu
*Assistant Examiner* — Niki Eloshway
(74) *Attorney, Agent, or Firm* — Luedeka, Neely & Graham, PC

(57) ABSTRACT

A pharmaceutical storing and dispensing device having a closure and container. The container includes a container axis and a neck having a container stop device, a container opening edge defining a container opening, and a container engaging device positioned to engage the closure. The closure is a one piece convertible child resistant closure comprising an outer section, an inner section, and at least one armature integrally formed between the inner section and the outer section and attaching the inner section to the outer section. The inner section is axially moveable relative to the outer section between a child resistant position and a non child resistant position to convert the closure from a child resistant mode to a non child resistant mode.

25 Claims, 15 Drawing Sheets

ONE PIECE CONVERTIBLE CLOSURE AND A ONE PIECE CONVERTIBLE CLOSURE AND CONTAINER SYSTEM

This application claims priority to U.S. Provisional Patent Application Ser. No. 60/866,458 entitled "ONE PIECE CONVERTIBLE CLOSURE AND A ONE PIECE CONVERTIBLE CLOSURE AND CONTAINER SYSTEM" filed Nov. 20, 2006. All applications and patents previously or subsequently mentioned are hereby expressly incorporated by reference in their entireties.

We, David A. Miceli, P.O. Box 600, Sparta, Tenn. 38583, and Joseph A. Miceli, P.O. Box 600, Sparta, Tenn. 38583, citizens of the United States, have invented a new and useful "ONE PIECE CONVERTIBLE CLOSURE AND A ONE PIECE CONVERTIBLE CLOSURE AND CONTAINER SYSTEM."

All patents and publications described or discussed herein are hereby incorporated by reference in their entirety.

BACKGROUND OF THE INVENTION

The present invention relates generally to a closure that may be applied to a vial, bottle, or other container, which can be described as a closure and container assembly, or closure and container system. The closure and container assembly stores and dispenses materials, particularly pharmaceuticals.

The closure is selectively manipulable between a child resistant configuration and a non-child resistant configuration. In its child resistant configuration, the closure provides an obstacle to children being able to remove the closure from the container. However, in its non-child resistant configuration, the closure allows for its ready removal from the container.

There are many types of child resistant closure systems described in the art. An example of a particular type of child resistant closure system is proposed in U.S. Pat. No. 5,449,078, which relates to a combination of a container and safety cap in which the cap continuously remains in a child resistant configuration. While many child resistant caps effectively provide protection against the danger of small children being able to remove potentially harmful contents, e.g. pills, from vials or other containers, they also provide a problem for a considerable portion of the adult population that require medication but lack the manual dexterity or strength to remove the child resistant cap. This is of a particular concern to the elderly population or people suffering from arthritis and other disabling diseases.

The most popular type of child-resistant closure is known in the art as a continuous threaded, torque actuated child resistant closure. These caps involve the use of two parts, one of which rests above the other in an axial configuration and which requires both a rotational and downward action to engage for removal. These are used in literally thousands of various applications and packaging configurations due to the universally understood push and turn mechanisms and the ease of use and adaptation in a wide variety of automated filing lines and processes. Most of these prior art torque actuated child resistant closures are continuously in a child resistant mode and, therefore, can pose a problem to the segment of the population needing the pharmaceuticals contained therein, but lacking the manual dexterity or strength to open the axially, torque actuated closures. Additionally, most of the torque actuated child resistant closures are composed of two separate pieces.

A typical example of this push and turn, torque actuated closure in the art includes two or more cap elements arranged such that an inner cap is nestled within an outer cap element wherein the inner and outer cap are equipped with an engaging device. The engaging device of the inner and outer caps can allow relative independent rotation or couple the inner and outer caps in order to remove the cap system from the container. Examples include those proposed in U.S. Pat. Nos. 4,520,938 and 7,000,789. The Inventors herein have observed that when the outer cap is made of resilient materials such as plastic, a risk exists in these types of patents that children could separate one cap from the other ("Shelling") thereby disabling the child resistant mode of operation. Once shelled, there is usually no other safeguard to restrict the access of the contents of the container by children.

Additionally, there have been prior art examples of reversible caps in which the cap has a child resistant side and a non-child resistant side such that a user of the cap and container system flips the cap 180 degrees to switch from the child resistant and non child resistant positions, such as seen in U.S. Pat. No. 6,926,161. While an effective solution to the problem these caps are susceptible to potential contamination by the switching between the child resistant and non child resistant configurations. For example, when one side of the cap (i.e. the NCR side) has been exposed for a period of time, reversal of the cap into the opposite mode positions the previously exposed side (in this example the NCR side) and any contaminates on that side to the pharmaceuticals contained within the vial.

Another example of a prior attempt at a closure system is disclosed in U.S. Pat. No. 5,579,934. This Patent proposes a container closure that is convertible between a configuration that resists opening by children and a configuration which may be easily opened without special manipulation of the closure. Specifically, the closure is manipulated into a non child resistant mode by "pressing down" on a central portion of the top surface of the closure. The action of pressing down moves the inner cap of the closure system relative to the outer cap and engages members inside the closure that restrict relative rotation between the inner and outer caps. This type of cap can also then be an effective solution to previous prior art problems. However, these caps are composed of two separately manufactured pieces that are then assembled. This increases the both the manufacturing cost and assembly time for the caps. Additionally, heretofore these caps have lacked the capability to properly include a warning to the consumer once this closure has been converted to its non child resistant configuration. This warning, or message, is normally required by the Consumer Product Safety Commission ("CPSC") to alert users that the closure has been converted into the non child resistant configuration.

Other reversible or convertible child resistant closures have been posed to address various problems. However, making the closure easier to convert into the non child resistant configuration increases the risk that these closures will inadvertently be converted to the non child resistant configurations. This obviously creates a health hazard. Similarly, there is an increased risk that the automated filling machines will inadvertently convert the closures to the non child resistant configurations when applying the closure to the container. Additionally various reversible and convertible child resistant designs that do include the CPSC consumer warning have projections that limit the use of those designs in automated dispensing equipment due to the projections on the outer surfaces or the overall configurations of those closures and/or caps.

In light of the foregoing there is need for a closure and container system that has a child resistant mode that effectively restricts access to the pharmaceuticals inside the container by children and allows access once a minimal torque threshold has been overcome. The closure and container system preferably has a non child resistant mode which may be opened without special manipulation. Preferably the closure is resistant to inadvertent conversion from its child resistant mode to its non child resistant mode, is composed of a one piece construction, and can be used in automated dismissing machines. This need closure and closure and container system is lacking in the art.

BRIEF SUMMARY OF THE INVENTION

The present invention is directed to a closure and a closure and container system that can substantially obviate one or more of the problems due to the limitations and disadvantages of the related art. Additional features and advantages of the invention will be set forth in the description which follows, and a part will be apparent from the description, or may be learned by practice of the invention. The objects and other advantages of the invention will be further realized and attained by the apparatus particularly pointed out in the description and claims hereof as well as the appended drawings.

Disclosed herein is a pharmaceutical storing and dispensing device having a closure and container. The pharmaceutical storing and dispensing device includes a child resistant mode and a non child resistant mode between the container and closure. More specifically, the closure is a one piece convertible child resistant closure for use with a container, the container including a container axis and a neck. The neck includes at least one container stop device, a container opening edge defining a container opening, and at least one container engaging device positioned to engage the closure.

The one piece convertible closure comprises an outer section, an inner section, and at least one armature integrally formed between the inner section and the outer section and attaching the inner section to the outer section. The closure includes a closure axis about which the closure is rotatable. The inner section is also coaxially positioned within the outer section and axially moveable relative to the outer section between a child resistant position and a non child resistant position to convert the closure from a child resistant mode to a non child resistant mode.

The outer section includes an outer circumferential sidewall including a first inner surface, a first outer surface, and a closure stop device positioned on the inner surface. The inner section includes a top and an inner circumferential sidewall extending from the top. The inner circumferential sidewall includes a second inner surface and a second outer surface. The second inner surface has a closing device for engagement with the container closing device.

Preferably, the inner and outer sections are separated by a radial distance measured from the closure axis. Each armature has an armature length wherein the radial distance is less than the armature length.

The plurality of armatures is positioned to radially space the inner section from the outer section. Additionally, this spacing of the inner section from the outer section by the armatures defines a gap between the inner section and the outer section. The armatures are also positioned to releasably inhibit axial movement of the inner section relative to the outer section such that the armatures releaseably inhibit movement between the child resistant mode and the non child resistant mode. This action is facilitated by a flexible attachment between the armatures and the inner and outer sections.

The outer surface of the outer section further includes a plurality of serrations positioned substantially parallel with the closure axis. The outer circumferential sidewall of the outer section defines an outer opening having an outer opening edge. The top of the inner section is exposed and visible through the outer opening edge. The top of the inner section is also positioned substantially planer with the outer opening edge when the closure is in the non child resistant mode and is spaced from the outer opening edge when the closure is in the child resistant mode.

The top of the inner section further includes a seal side shaped to engage a container opening edge. The seal side forms a seal with the container opening edge when the closure is secured to the container. The engagement between the seal side of a top and a container opening edge limits the axial and rotational movement of the closure relative to the container in a direction of attachment of the closure to the container.

The closure stop device is positioned to engage the container stop device when the closure is in the child resistant mode. This limits rotational movement of the closure relative to the container in a direction of removal of the closure from the container when in the child resistant mode. The closure stop device is also positioned to pass by the container stop device when the closure is in the non child resistant mode. This allows rotational movement of the closure relative to the container in a direction of removal of a closure from a container when in the non child resistant mode.

It is therefore a general object of the present invention to provide a convertible child resistant closure for use with a container.

Another object of the present invention is to provide a child resistant closure that is convertible between a child resistant mode, or configuration, and a non child resistant, or configuration.

Still another object of the present invention is to provide a convertible closure and container system.

Yet another object of the present invention is to provide a one piece convertible closure for use with a container for pharmaceuticals.

Another object of the present invention is to provide a closure having a one piece construction such that an inner section is axially moveable relative to an outer section.

Yet another object of the present invention is to provide a closure having an inner section connected to an outer section through armatures such that the armatures facilitate a limited movement of the inner section relative to the outer section.

Another object of the present invention is to provide a convertible child resistant closure that selectively exposes a warning to the user that the cap is not child resistant when the cap is in a non child resistant mode.

Other and further objects, features and advantages of the present invention will be readily apparent to those skilled in the art upon reading of the following disclosure when taken in conjunction with the accompanying drawings.

BRIEF DESCRIPTION OF THE SEVERAL VIEWS OF THE DRAWINGS

FIG. 12 shows the closure in a child resistant configuration.

DETAILED DESCRIPTION OF THE INVENTION

Figure 1:
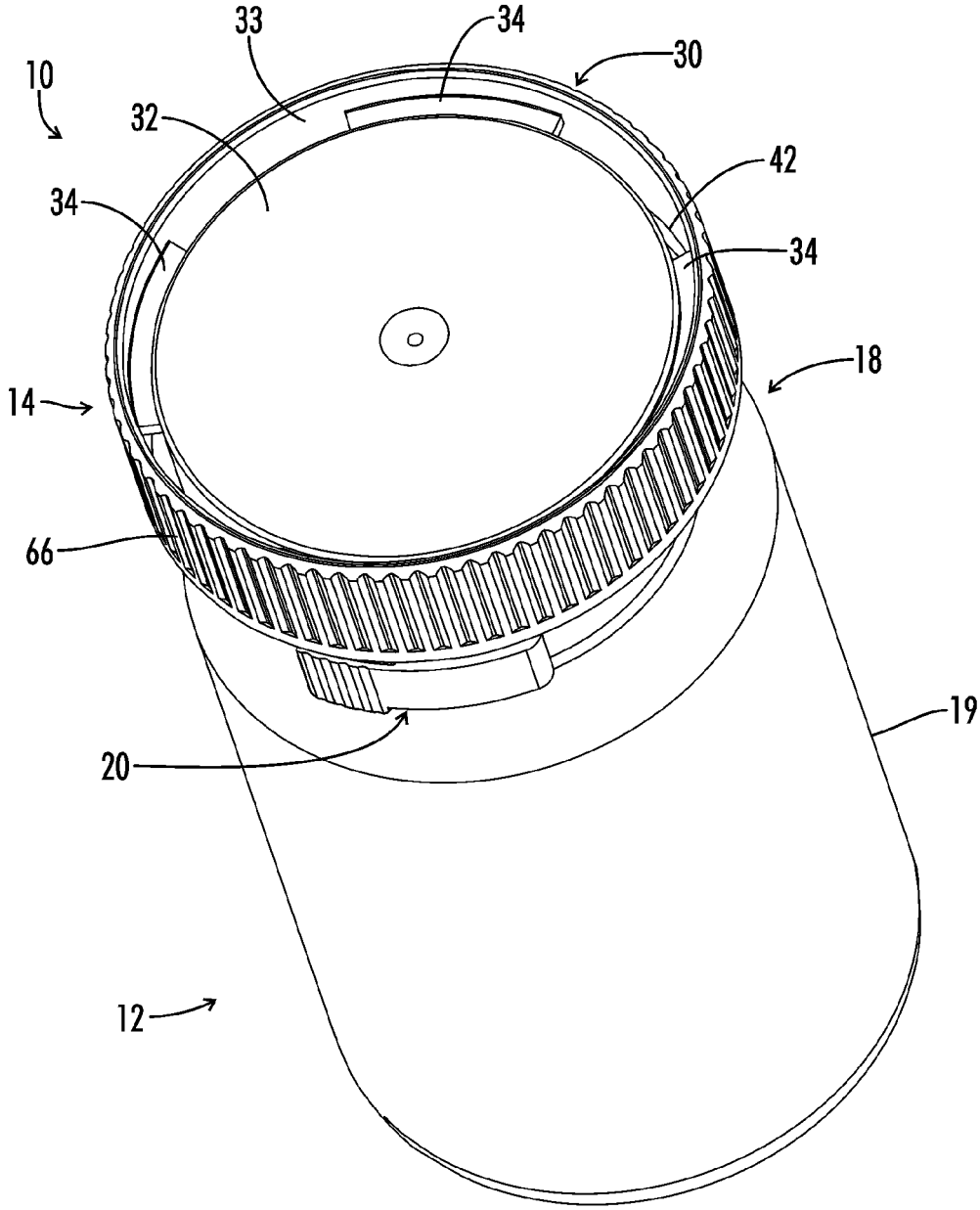
FIG. 1 is a perspective view of a closure and container system made in accordance with the current disclosure wherein the closure is positioned in a non child resistant mode or configuration.
Figure 2:
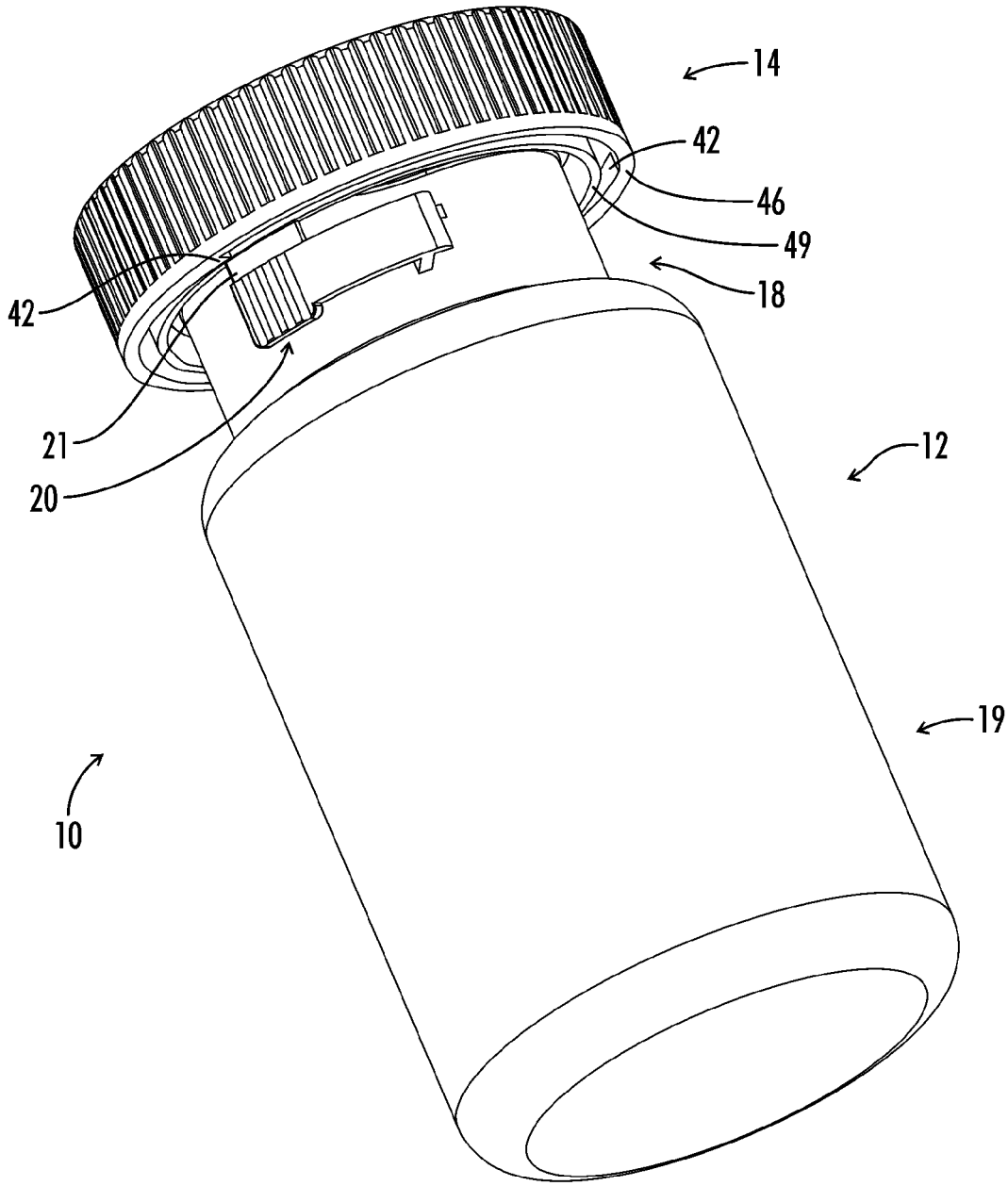
FIG. 2 is an alternate perspective view of the closure and container system shown in FIG. 1.

Referring now to FIGS. 1-21, a convertible closure and container pharmaceutical system is shown and generally designated by the numeral 10. The system 10 comprises a container 12 in operation with a closure 14. The system 10 preferably has both a child resistant mode and a non child resistant mode wherein the conversion between the modes is preferably controlled through the closure 14 and its interaction with the container 12.

The container 12, which can be described as a vial or bottle, includes a container axis 16 and a neck 18. The neck 18 includes a container stop device 20, container engaging device 22, and a container opening edge 24 defining a container opening 26.

In a preferred embodiment the neck 18 has a smaller radial dimension than the remainder of the body 19 of the container 12. Alternately, the neck 18 can have substantially the same diameter as the body 19. The container engaging device 22, which can also be described as a container closing device 22, can be those devices known in the art to engage containers and closures including, but not limited to, as single or multiple threads, beads, cams, lugs and the like.

The container stop device 20 preferably comprises deflectable tabs, as illustrated in FIGS. 1-6, but can be other devices known in the art to releaseably engage portions of the closure 14 including various protrusions extending from the neck 18 of the container 12. Preferably the tabs 20 are radially deflective with respect to the neck 18. Alternately, the tabs 20 can be axially deflectable relative to the neck 18. This deflection can disengage the tabs 20 from various portions of the closure 14 to allow disengagement of the closure 14 with respect to the container 12, as will be further described.

The one piece closure 14 has a child resistant mode when applied to the container 12 in a child resistant configuration and has a non child resistant mode when applied to the container 12 in a non child resistant configuration. The one piece closure 14, which can also be described as a one piece convertible cap 14, includes a closure axis 28, an outer section 30, an inner section 32, and at least one armature 34 integrally formed between the inner and outer sections 32 and 30. The armatures 34 attach the inner section 32 to the outer section 30.

The outer section includes an outer circumferential side wall 36 having a first inner surface 38, a first outer surface 40 and a closure stop device 42 positioned on the first inner surface 38. The outer circumferential side wall 36 defines a top outer opening edge 44 and a bottom outer opening edge 46. The closure stop device 42, which preferably includes multiple projections that extend inwardly from the inner surface 38, is positioned on the inner surface 38 proximate to the bottom outer opening edge 46. The closure stop device 42 is positioned to engage the tabs 20 of the container 12 when the closure 14 is in the child resistant mode to limit rotational movement of the closure 14 relative to the container 12. This limited rotational movement is in a direction of removal of the closure 14 from the container 12.

The inner section 32 includes an inner section top 48 and an inner circumferential side wall 50 extending from the top 48. The inner circumferential side wall 50 includes a second inner surface 52 and a second outer surface 54 wherein the second inner surface 52 includes a closure engaging device 56, which can also be described as a closure closing device 56, positioned to engage the container closing device 22. Preferably the closure engaging device 56 corresponds to the container engaging device 22. The closure engaging device 56 is illustrated as at least one thread, but can be other things known in the art to corresponding to the container engaging device 22 such as single or multiple beads, cams, lugs, and the like.

The inner section top 48 includes a container side 58, which can also be described as a seal side 48, positioned to engage the container opening edge 24. The engagement between the container opening edge 24 and container side 58 limits the axial and rotational movement of the closure 14 relative to the container 12 in a direction of attachment of the closure 14 to the container 12 when the closure 14 is secured to the container 12.

The inner section 32 is coaxially positioned within the outer section 30 and axially moveable relative to the outer section 30 between a child resistant position and a non child resistant position to convert the closure 14 from a child resistant mode to a non child resistant mode. This movement is facilitated by the armatures 34, which can also be described as connectors 34, that are formed as an integral part of both the inner and outer sections 32 and 30. For example, the armatures 34 are flexibly attached to the inner and outer section 32 and 30 to allow bending at the connection of the armatures 34 to the inner section 32 and outer section 30. This bending facilitates an overall relative movement of the armatures 34, inner section 32, and outer section 30.

The armatures also facilitate the separation of the inner section 32 and outer section 30 by a radial distance 31, which forms a gap 60 between the outer and inner sections 30 and 32. The support of the inner section 32 relative to the outer section 30 is facilitated by the armatures 34. The armatures 34 include an armature length 35 that is longer than the radial distance 31.

This comparative difference in the armature length 35 and radial distance 31 not only spaces the inner section 32 from the outer section 30 and facilitates the gap 60, this length difference also releaseably inhibits axial movement of the inner section 32 relative to the outer section 30 between the child resistant mode and a non child resistant mode. This inhibited movement facilitates the desired configuration, the child resistant or non child resistant, to be maintained in the closure 14 as desired by a user of the system 10. For example, an axial force is required to move the inner section 32 relative to the outer section 30 to convert the closure 14 from the child resistant mode to the non child resistant mode or vice versa. This is best explained by the movement of the inner section 32 relative to the outer section 30 imparting at least a partial flex of the outer circumferential side wall 36 radially outward as the attachment location 62 of the armatures 34 to the inner section 32 passes the attachment location 64 of the armatures 34 to the outer section 30.

In a first preferred embodiment, as shown in FIGS. 1-16, the closure 14 includes a plurality of armatures 34. The number of armatures can correspond to the number of closure stop devices 42 on the inner surface 38 or be greater than the number of closure stop devices 42. The armatures 34 define an armature opening 33 between adjacent armatures 34. In an alternate preferred embodiment, as shown in FIGS. 17-21, the closure 14 can include a single armature 34 having an armature opening 33. This armature opening 33 is aligned with the closure stop device 42 on the inner surface 38.

The numerical correspondence of armature openings 33 to closure stop devices 42 in either embodiment facilitates the manufacture of the closure 14. This simplifies the die formation and molding operation use to form the closure 14 by providing an entry for a support used to form the closure stop device 42.

In a preferred embodiment the inner section top 48 is visible through the top outer opening edge 44 of the outer section 30. The inner section top 48 is positioned substantially planar with the top outer opening edge 44 when the closure 14 is in the non child resistant mode. The inner section top 48 is spaced from the top outer opening edge 44 when the closure 14 is in the child resistant mode. Correspondingly the inner section bottom 49 is positioned substantially planar with the bottom outer opening edge 46 when the closure 14 is in the child resistant mode and spaced from the bottom outer opening edge 46 when the closure 14 is in the non child resistant mode. This movement facilitates the conversion of the closure 14 between the child resistant and non child resistant modes.

Figure 3:
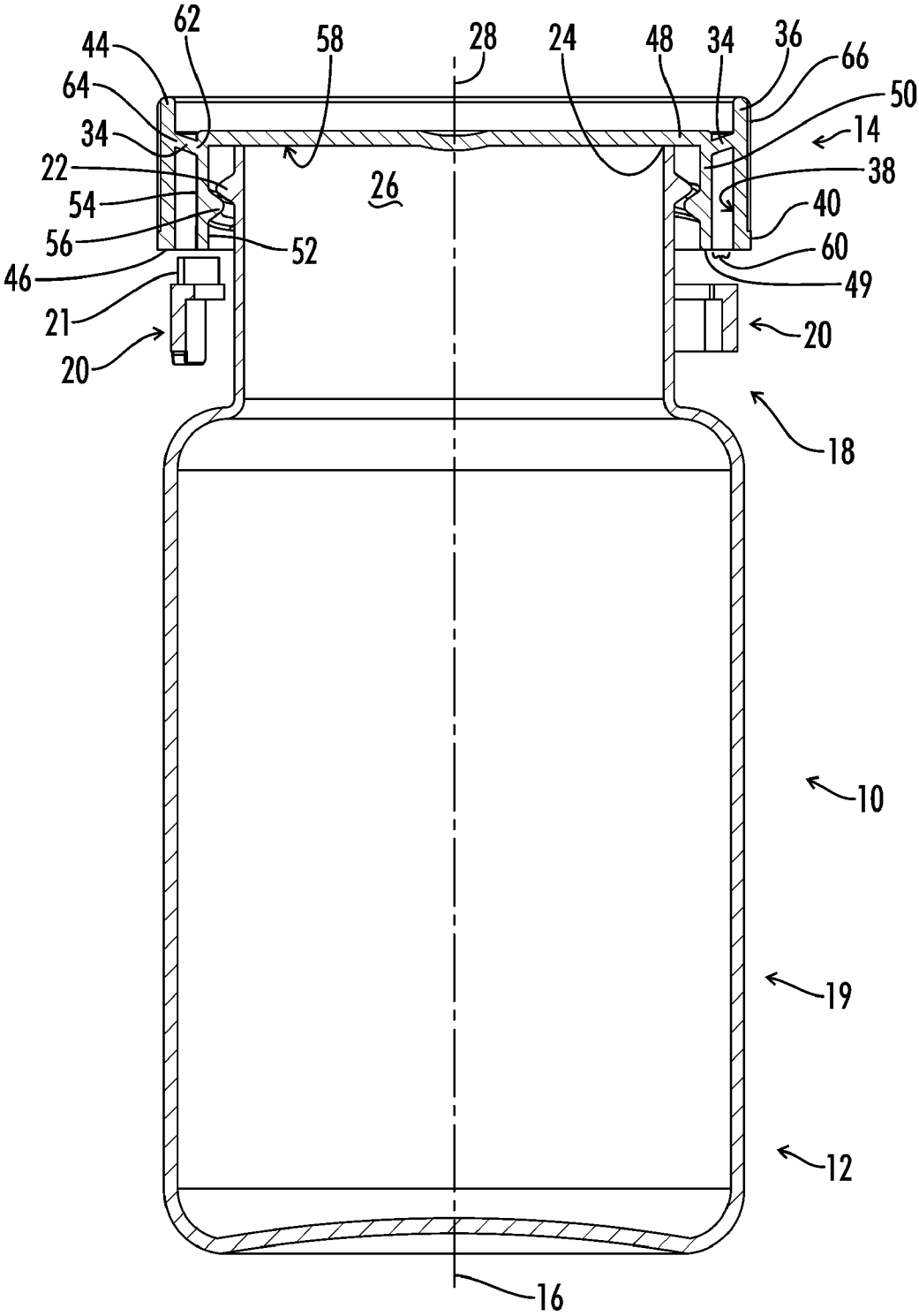
FIG. 3 is a cross sectional view of the closure and container system shown in FIGS. 1-2.
Figure 4:
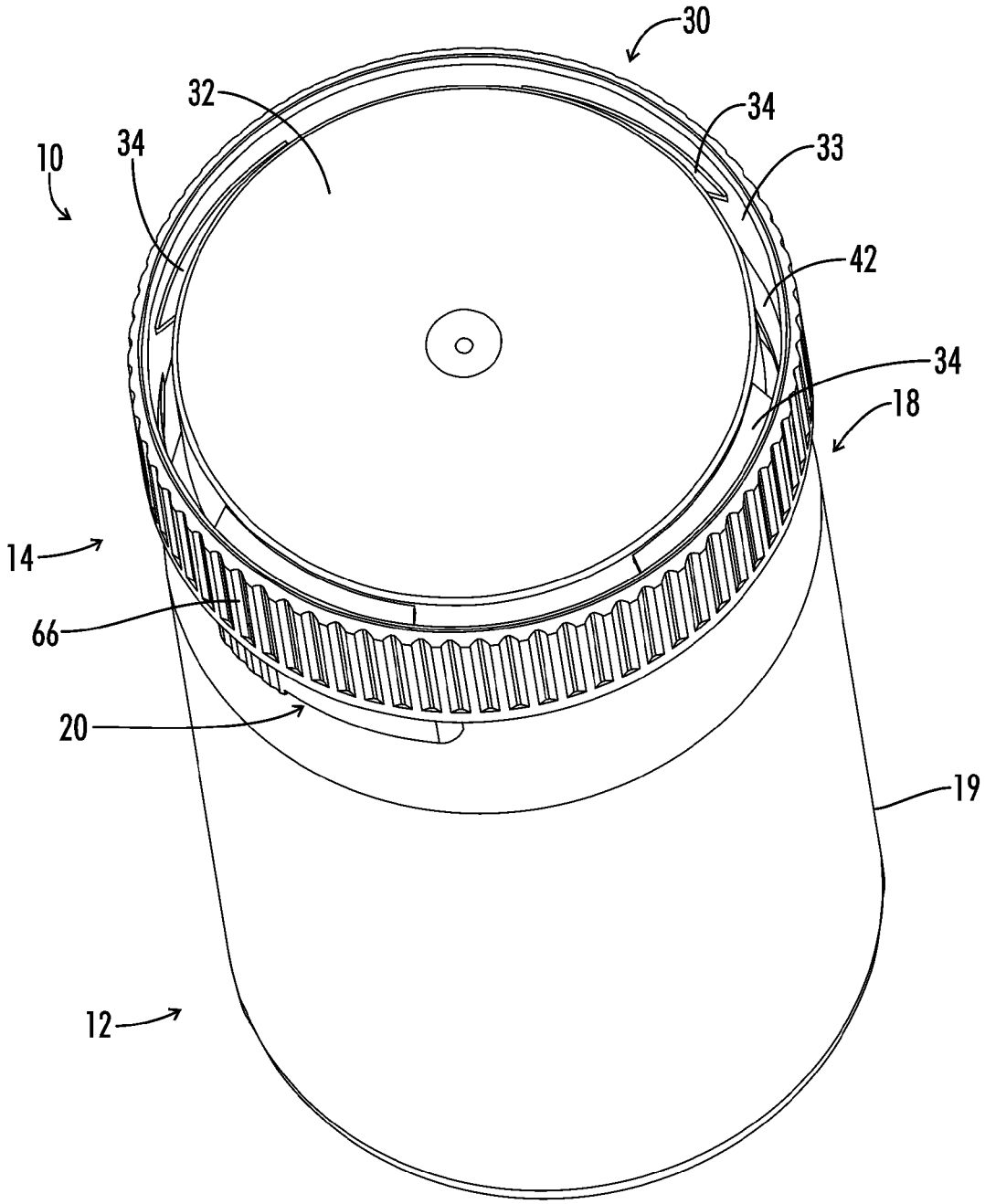
FIG. 4 is a perspective view of a container and closure system made in accordance with the current disclosure wherein the closure is in a child resistant mode.
Figure 5:
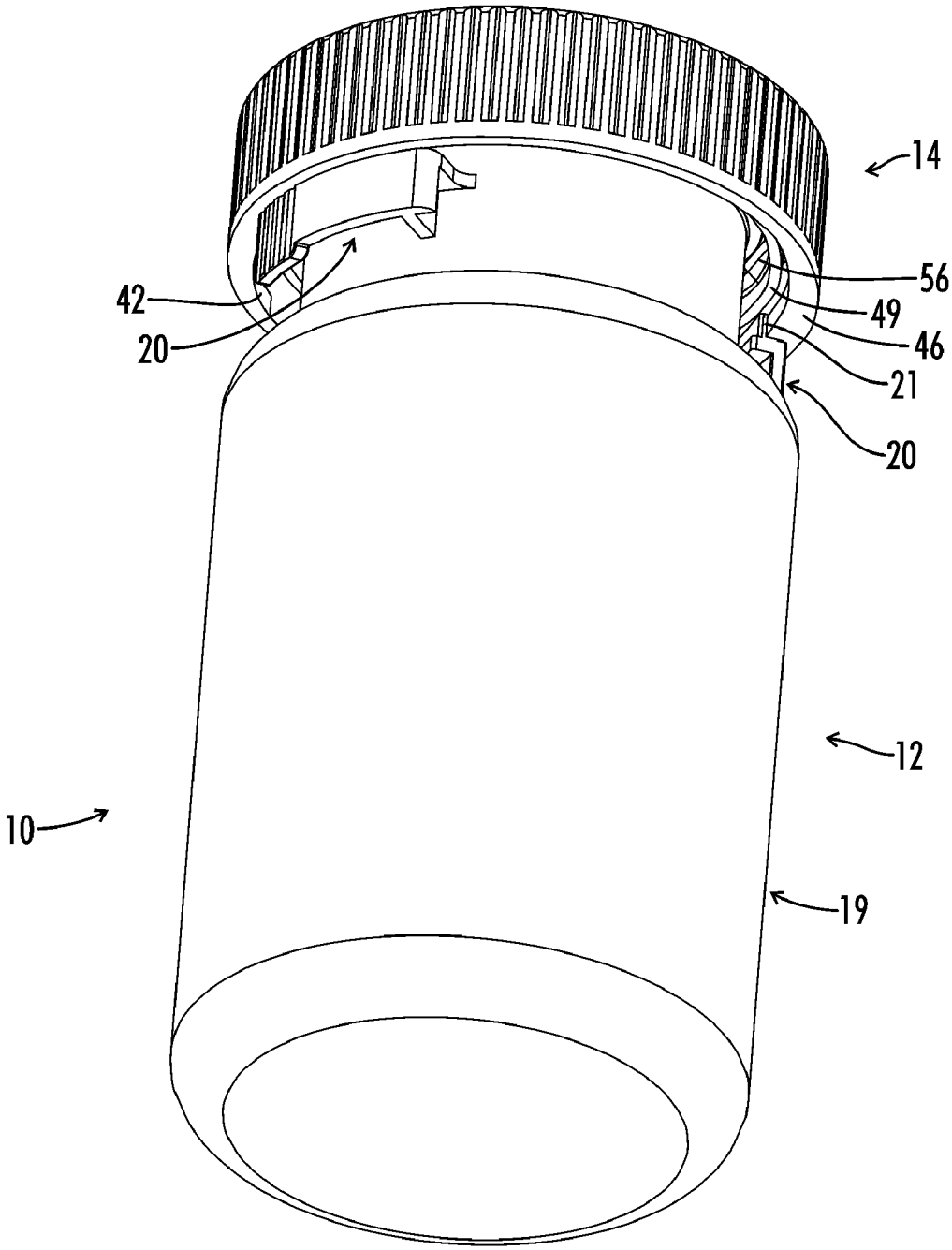
FIG. 5 is an alternate perspective view of the closure and container system shown in FIG. 4.

For example, when the closure 14 is in the non child resistant mode the inner section bottom 49 is positioned proximate the bottom outer opening edge 46. This facilitates engagement between the closure engaging device 56 and the container engaging device 22 such that the closure stop device 42 on the outer circumferential sidewall 36 is spaced above the tabs 20 on the container 12. The spacing allows the closure stop device 42 to pass by and/or over the container stop device 20 as the closure 14 is rotated relative to the container 12. This is best seen in FIG. 3.

Figure 6:
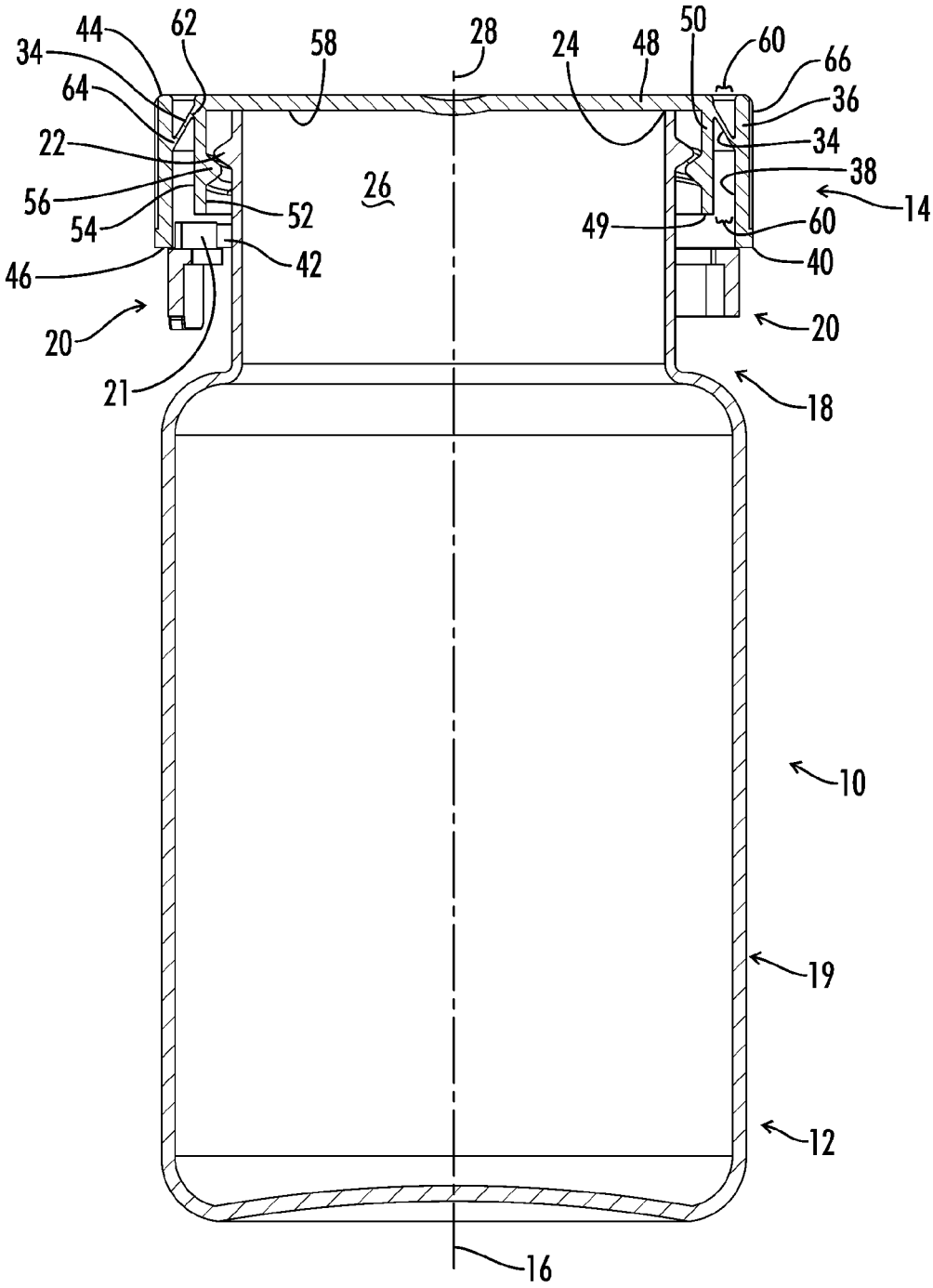
FIG. 6 is a cross-sectional view of the container shown in FIGS. 4-5.
Figure 7:
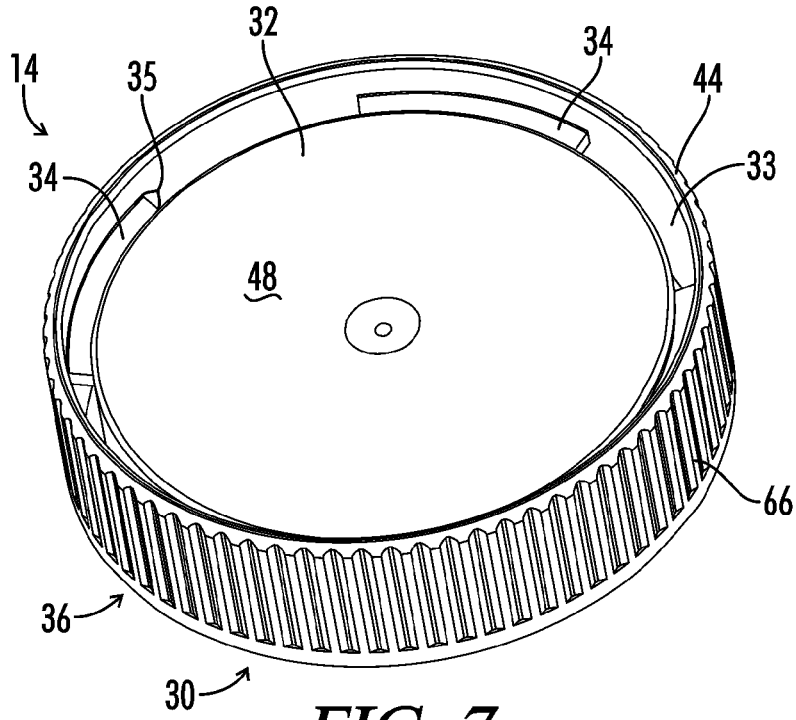
FIG. 7 is a top perspective view of a closure made in accordance with the current disclosure. The closure is shown in a non-child resistant configuration.
Figure 8:
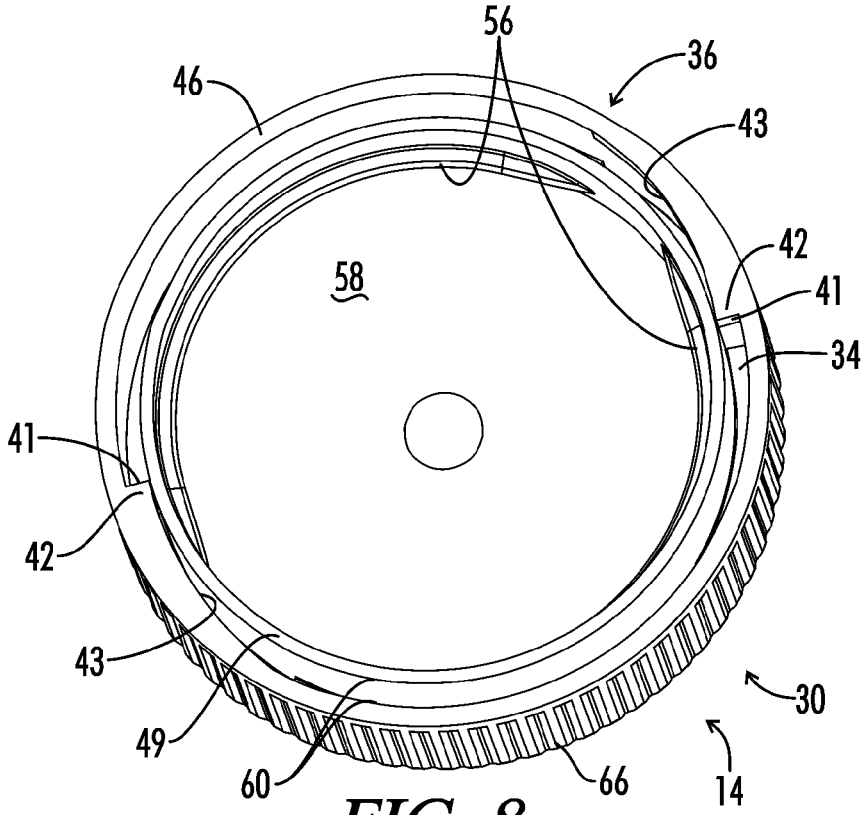
FIG. 8 is a bottom perspective view of the closure shown in FIG. 7.
Figure 9:
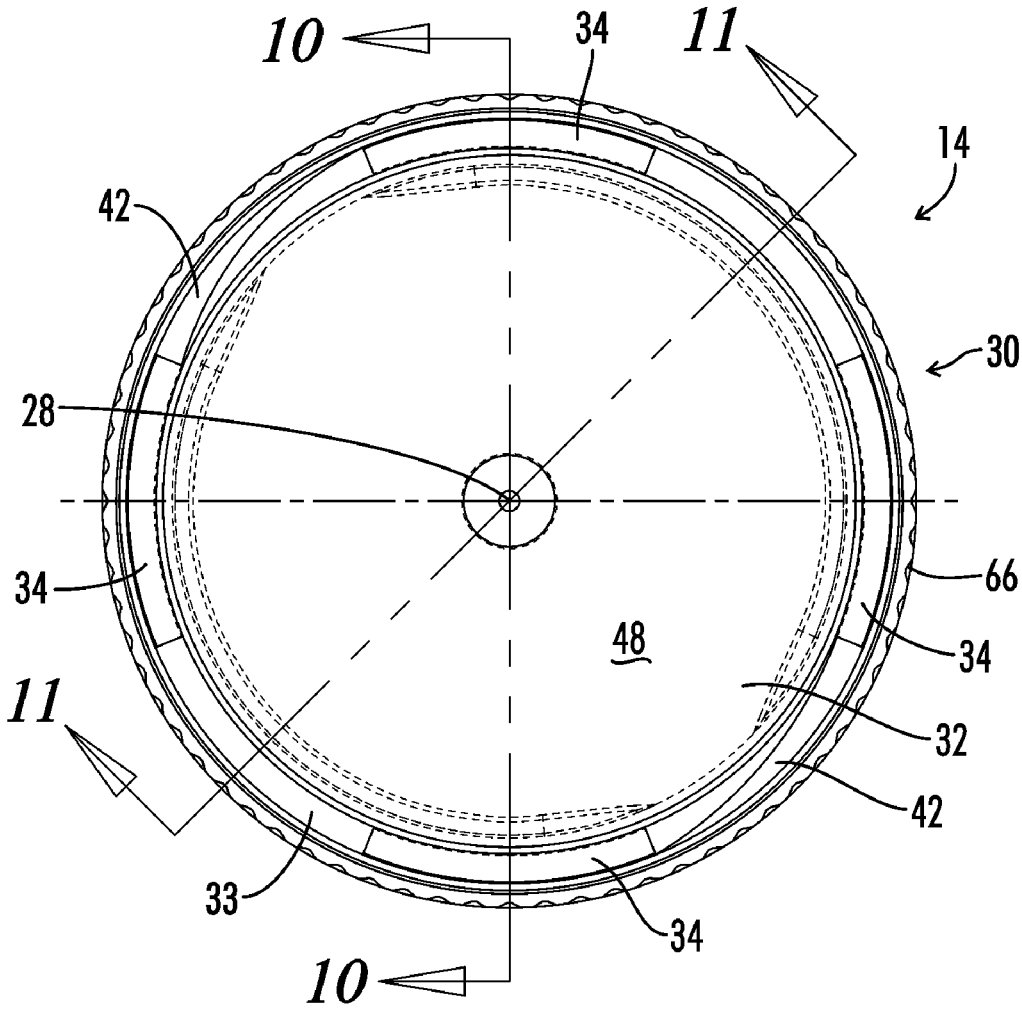
FIG. 9 is a bottom view of a cap shown in FIG. 7-8.
Figure 10:
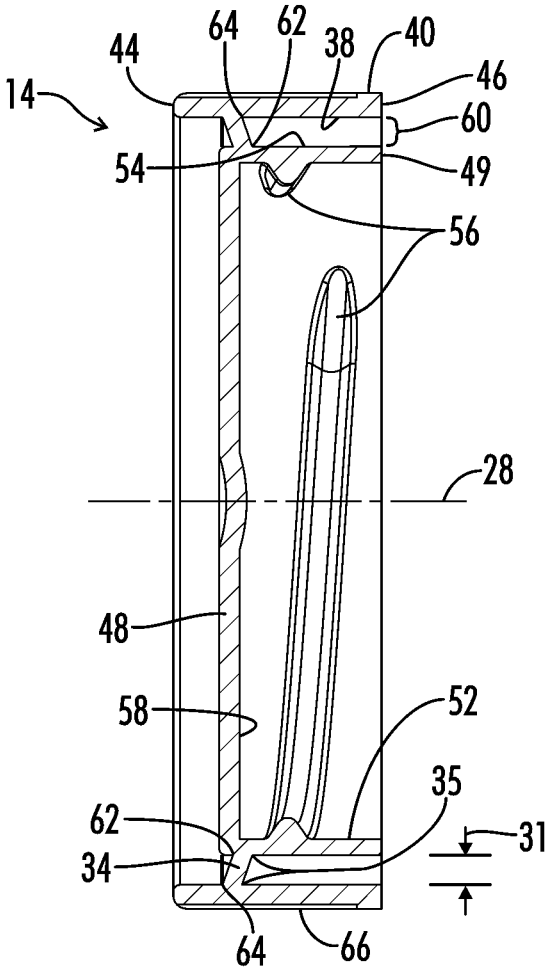
FIG. 10 is a cross sectional view of a cap shown in FIGS. 7-9 taken along line 10-10 in FIG. 9.
Figure 11:
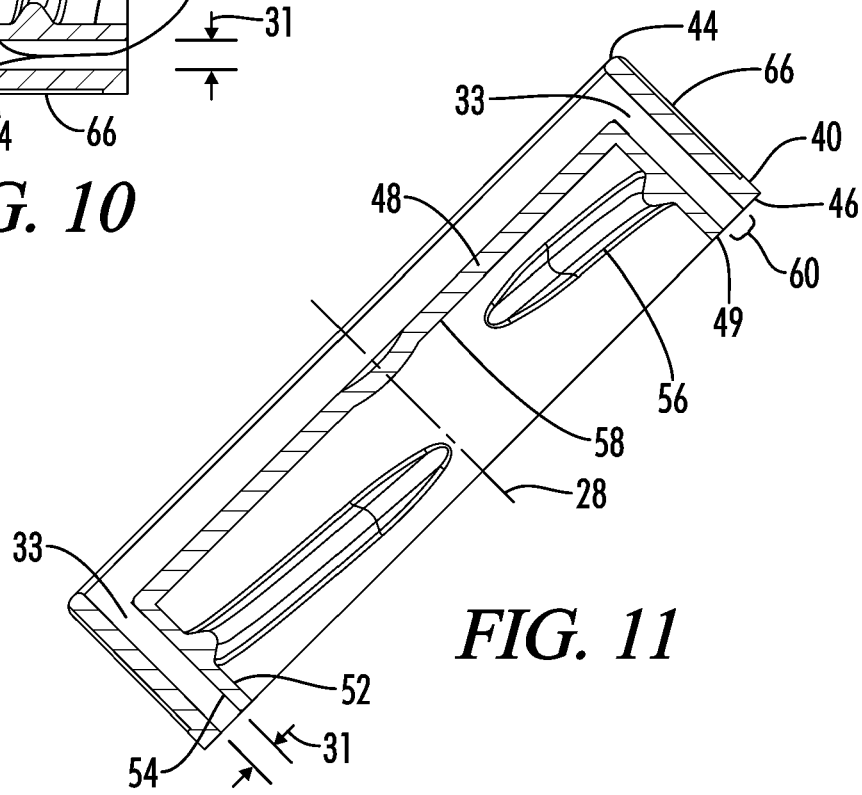
FIG. 11 is a cross sectional view of the closure shown in FIGS. 7-10 taken along line 11-11 in FIG. 9.
Figure 12:
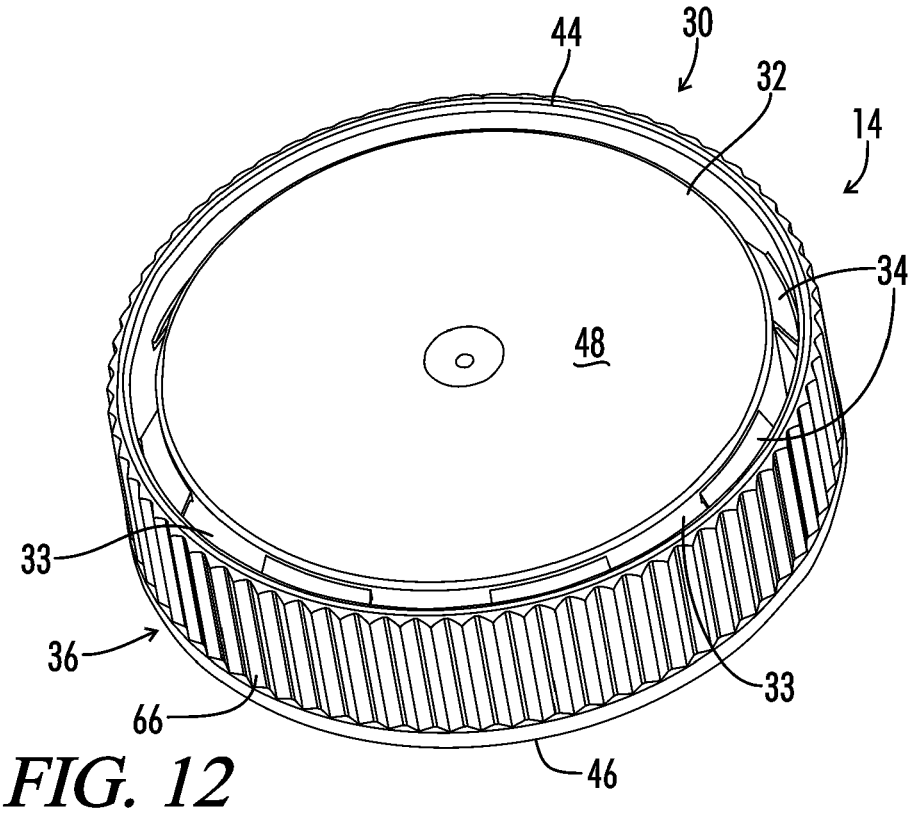
FIG. 12 is a top perspective view of a closure made in accordance with the current disclosure.
Figure 13:
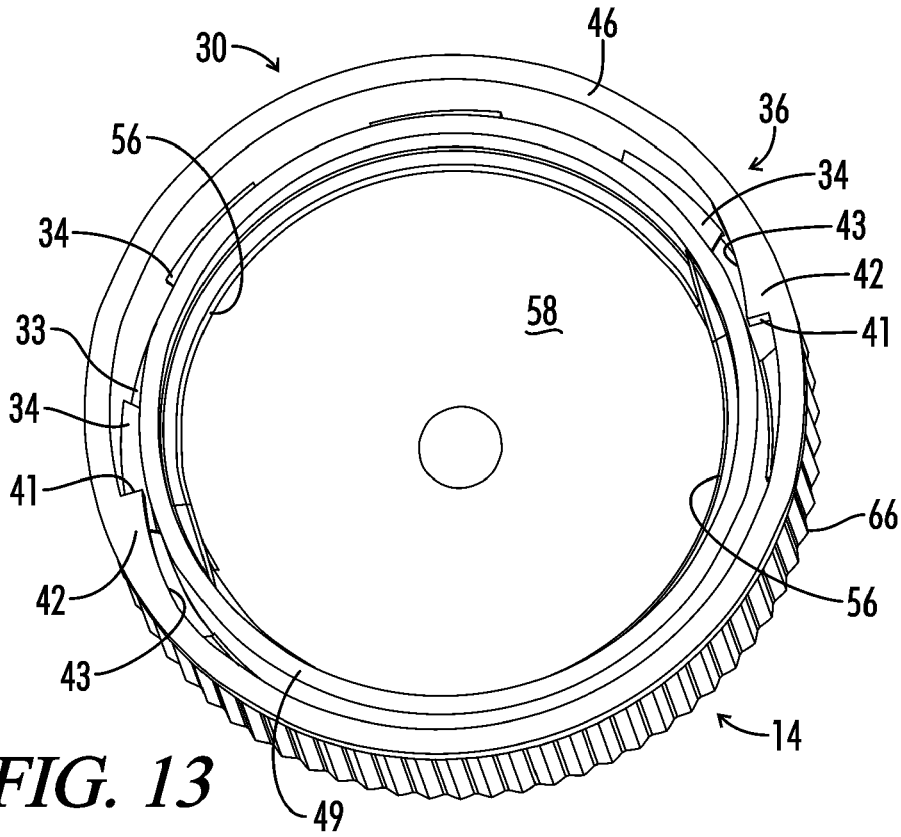
FIG. 13 is a bottom perspective view of the closure shown in FIG. 12.
Figure 14:
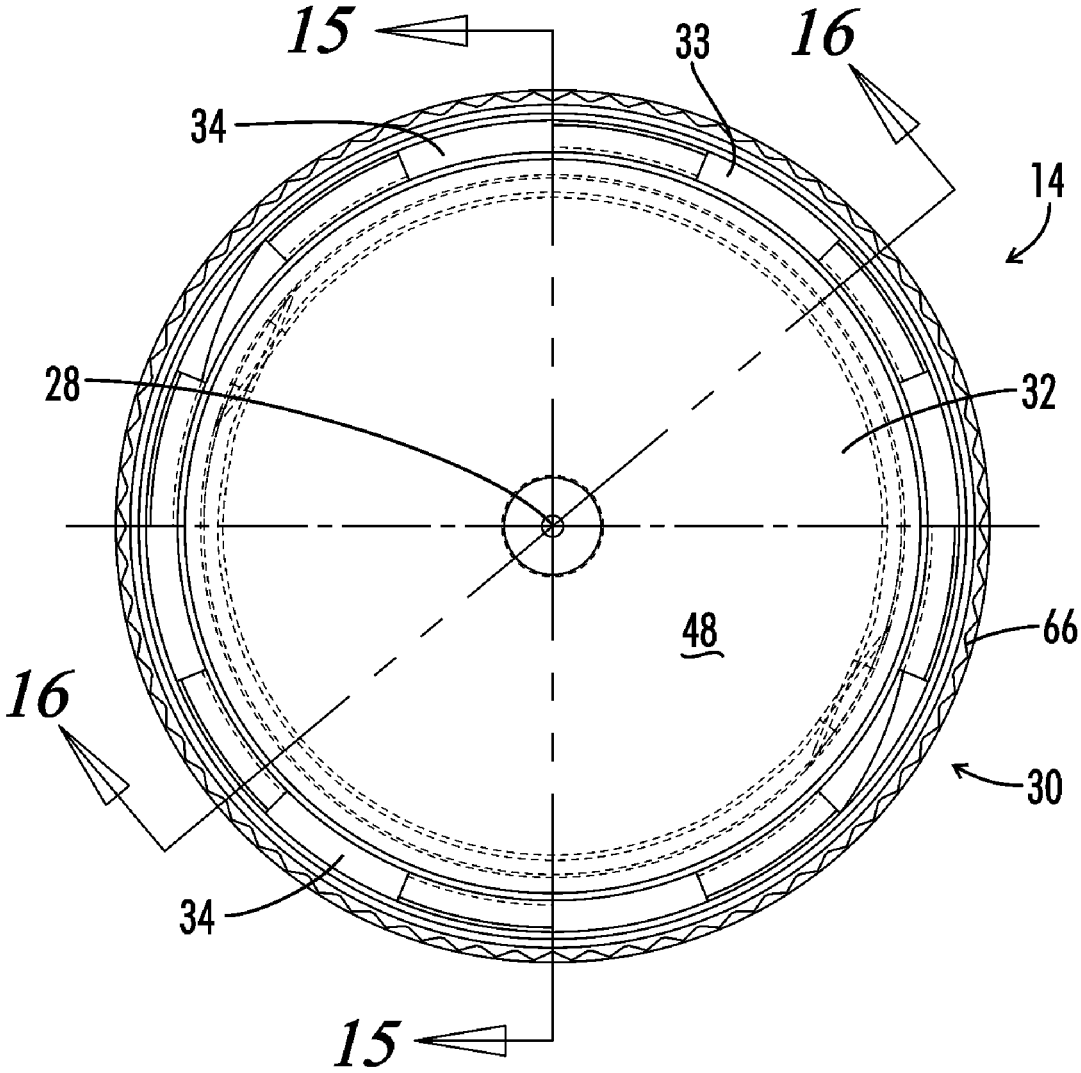
FIG. 14 is a bottom view of the closure shown in FIGS. 12-13.
Figure 15:
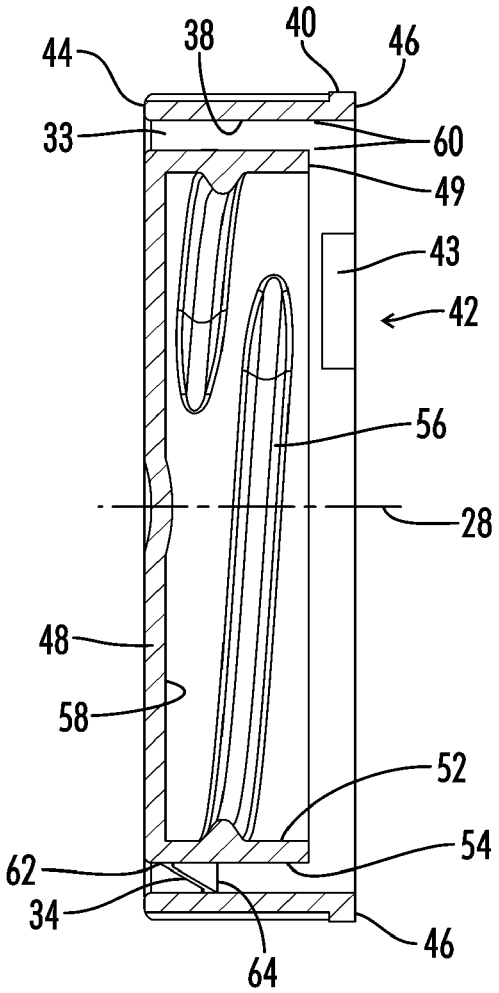
FIG. 15 is a cross sectional view of a closure shown in FIGS. 12-14 taken along line 15-15 of FIG. 14.
Figure 16:
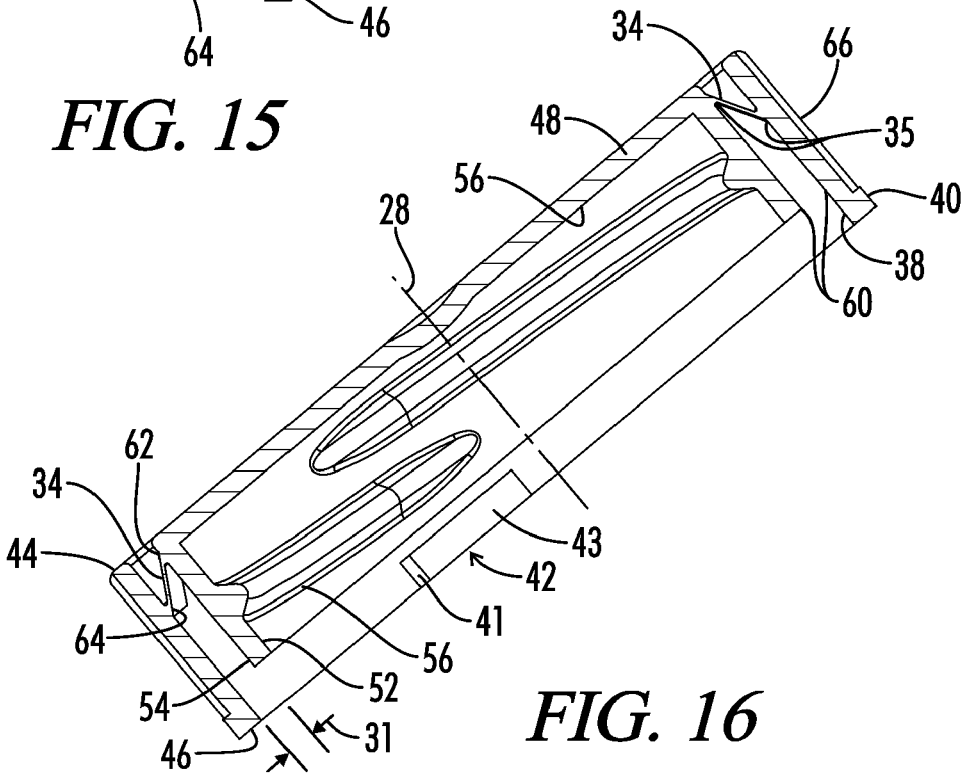
FIG. 16 is a cross sectional view of a closure shown in FIGS. 12-15 taken along line 16-16 of FIG. 14.
Figure 17:
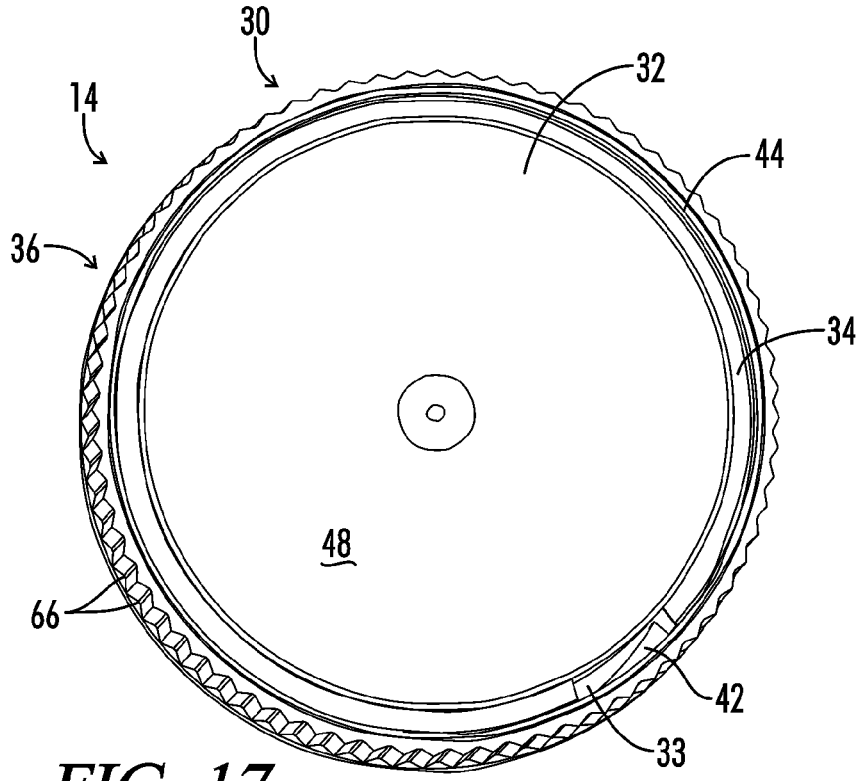
FIG. 17 is a top perspective view of a closure made in accordance with the current disclosure. The closure is shown in a child resistant configuration.
Figure 18:
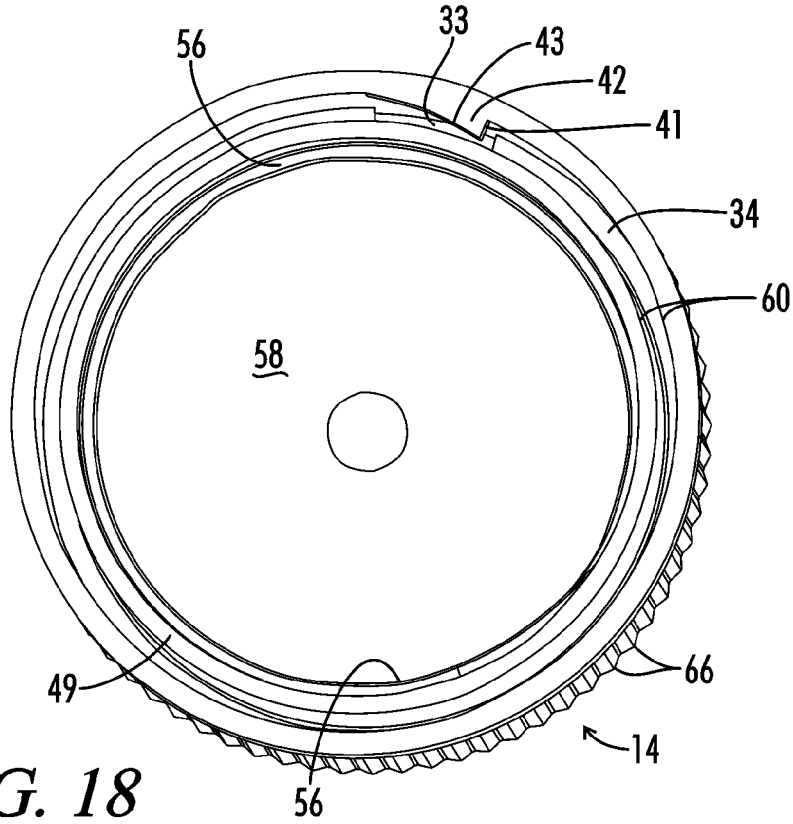
FIG. 18 is a bottom perspective view of the closure shown in FIG. 17.
Figure 19:
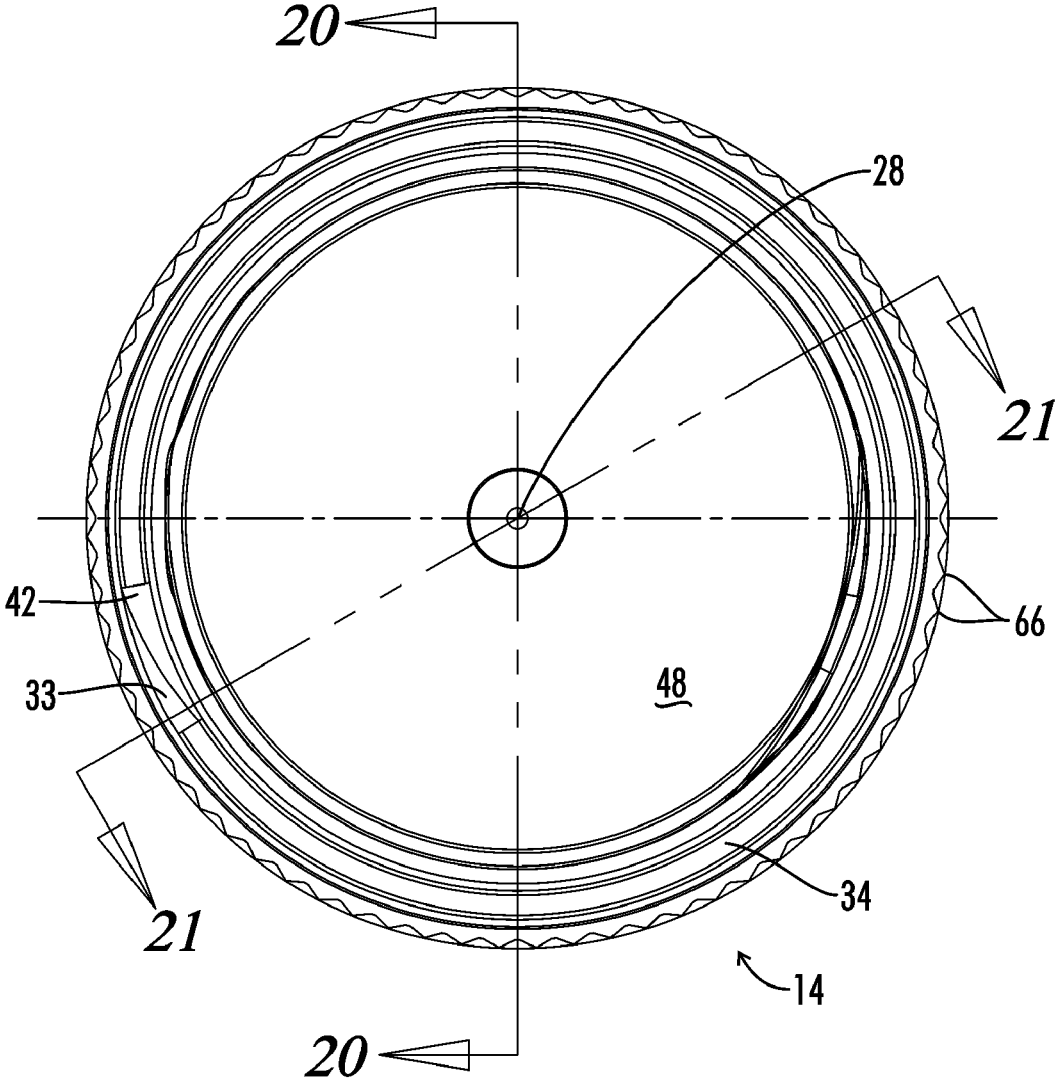
FIG. 19 is a bottom view of a cap shown in FIG. 17-18.
Figure 20:
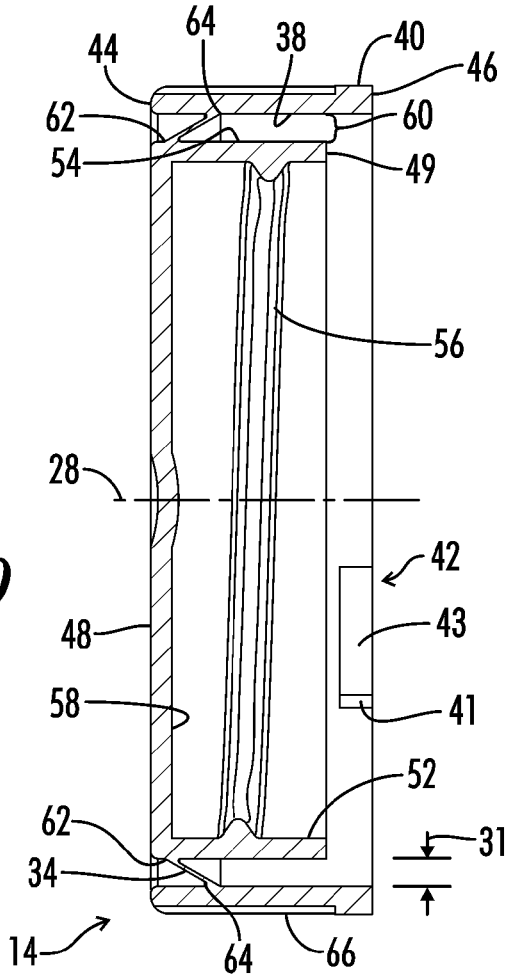
FIG. 20 is a cross sectional view of a cap shown in FIGS. 17-19 taken along line 20-20 in FIG. 19.
Figure 21:
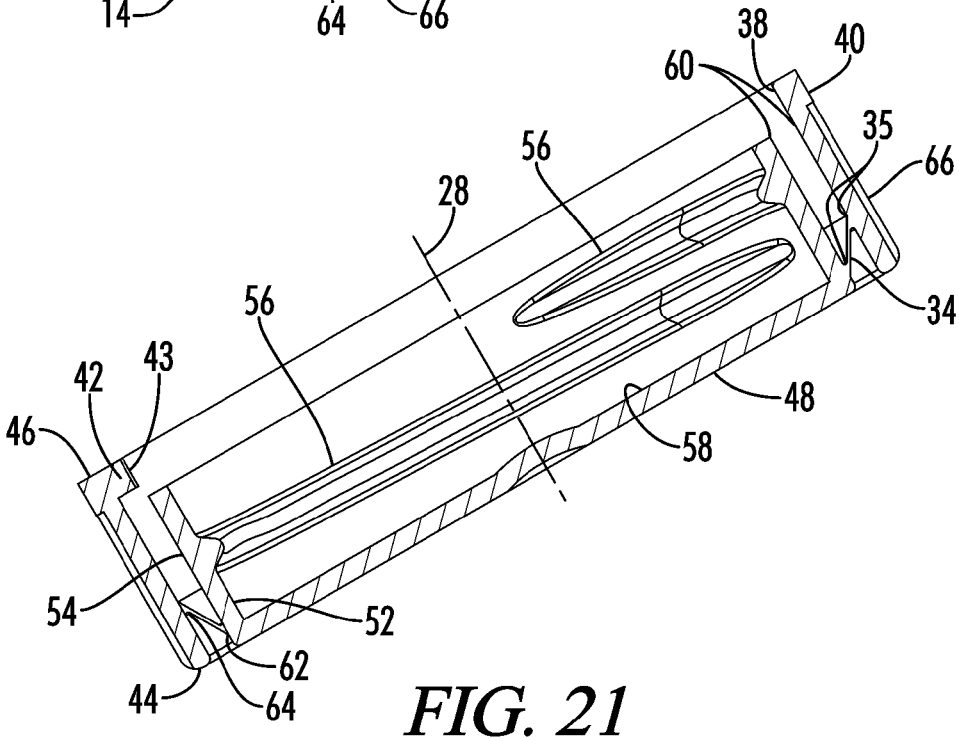
FIG. 21 is a cross sectional view of the closure shown in FIGS. 17-20 taken along line 21-21 in FIG. 19.

Alternately, when the closure 14 is in the child resistant mode the inner section bottom 49 is spaced from the bottom outer openings edge 46 such that the container stop device 20 and closure stop device 42 engage during rotation of the closure 14 relative to the container 12. For example, when the closure 14 is in the child resistant mode the ramp surfaces 43 of the closures stop device 42 will engage the protrusions 21 of the tabs 20 as the closure 14 is rotated in a closing direction onto the container 12. As the closure 14 is rotated into a closing position with respect to the container 12, the protrusions 21 will pass the ramp surfaces 43 and engage the abutment surfaces 41 of the closure stop device 42. This engagement between the abutment surfaces 41 and the protrusions 21 will restrict movement of the closure 14 relative to the container 12 in the child resistant mode. To release the closure 14 from the container 12 the tabs 20 are pressed such that the protrusions 21 will pass by the abutment surfaces 41. This movement can be a radial inward direction or an axially downward direction. Once this movement occurs the closure 14 can then be rotated, as facilitated by the serrations 66, in an opening direction to remove the closure 14 from the container 12. This engagement is best seen in FIG. 6.

Thus, although there have been described particular embodiments of the present invention of a new and useful ONE PIECE CONVERTIBLE CLOSURE AND A ONE PIECE CONVERTIBLE CLOSURE AND CONTAINER SYSTEM, it is not intended that such references be construed as limitations upon the scope of this invention except as set forth in the following claims.

What is claimed is:

1. A one piece convertible closure for use with a container having at least one container stop device, at least one container closing device, a container opening edge defining a container opening, and a container axis; the one piece convertible closure comprising:

a closure axis about which the closure is rotatable;

an outer section including an outer circumferential side wall including a first inner surface, a first outer surface, and at least one closure stop device positioned on the inner surface;

an inner section including a top and an inner circumferential side wall extending from the top, the inner circumferential side wall including a second inner surface and a second outer surface, the second inner surface having at least one closure closing device for engagement with the container closing device;

at least one armature integrally formed between the inner section and the outer section and attaching the inner section to the outer section; and the inner section being coaxially positioned within the outer section and axially movable relative to the outer section between a child resistant position and a non-child resistant position to convert the closure from a child resistant mode to a non-child resistant mode, the armature being dimensioned to releaseably maintain the inner and outer sections in the child resistant position and to releaseably maintain the inner and outer sections in the non-child resistant position, the armature and outer section being bendable to allow and inhibit the relative axial movement of the sections to and from the child resistant position and the non-child resistant position in response to axial forces applied between the sections.

2. The closure of claim 1, wherein the inner section and the outer section are separated by a radial distance and the armature has an armature length, wherein the radial distance is less than the armature length.

3. The closure of claim 1, wherein the armature is positioned to radially space the inner section from the outer section to and define a gap between the inner section and the outer section.

4. The closure of claim 1, wherein the armature is positioned to releasably inhibit axial movement of the inner section relative to the outer section between the child resistant mode and the non-child resistant mode.

5. The closure of claim 1, wherein the armature is flexibly attached to the inner section and the outer section.

6. The closure of claim 1, the first outer surface of the outer section further including a plurality of serrations positioned substantially parallel with the closure axis.

7. The closure of claim 1, wherein the outer circumferential side wall defines an outer opening having an outer opening edge and the entire top of the inner section is exposed and visible through the outer opening.

8. The closure of claim 7, wherein:

the top of the inner section is positioned substantially planer with the outer opening edge when the closure is in the child resistant mode; and the top of the inner section is spaced from the outer opening edge when the closure is in the non-child resistant mode.

9. The closure of claim 1, wherein the top of the inner section further includes a seal side shaped to engage the container opening edge and forms a seal with the container opening edge when the closure is secured to the container.

10. The closure of claim 9, wherein the engagement between the seal side of the top and the container opening edge limits the axial and rotational movement of the closure relative to the container in a direction of attachment of the closure to the container.

11. The closure of claim 1, wherein the closure stop device is positioned to engage the container stop device when the closure is in the child resistant mode to limit rotational movement of the closure relative to the container in a direction of removal of the closure from the container.

12. The closure of claim 11, wherein the closure stop device is positioned to pass by the container stop device when the closure is in the non-child resistant mode to allow rotational movement of the closure relative to the container in a direction of removal of the closure from the container.

13. The cap of claim 1, wherein the armature includes at least one aperture corresponding to each closure stop device.

14. A convertible cap for use with a container having a container stop device, container closing device, a container opening edge defining a container opening, and a container axis, the one piece convertible cap comprising:

a cap axis about which the cap can rotate;

an outer section having an outer circumferential side wall including a first inner surface, a first outer surface, and at least one cap stop device, the outer circumferential side wall defining a top outer opening edge and a bottom outer opening edge, the at least one cap stop device positioned on the inner surface;

an inner section including an inner section top, an inner section bottom, and an inner circumferential side wall extending from the inner section top, the inner section top including a container side shaped to engage the container opening edge when the cap is secured to the container, the inner circumferential side wall including a second inner surface and a second outer surface, the second inner surface having a cap closing device for engagement with the container closing device;

at least one connector attaching the inner and outer sections;

the outer section being coaxially positioned around the inner section and axially movable relative to the inner section between a first child resistant position and a first non-child resistant position to convert the cap from a child resistant mode to a non-child resistant mode, wherein the at least one connector, inner section and outer section are dimensioned and positioned to releasably maintain the inner and outer sections in the non-child resistant position and to releaseably maintain the inner and outer sections in the child resistant position; and the at least one cap stop device positioned to pass above the container stop device when the cap is engaging the container and in the non-child resistant mode to allow rotational movement of the cap relative to the container in a direction of removal of the cap from the container.

15. The cap of claim 14, wherein the container side forms a seal with the container opening edge when the cap is secured to the container in both the child resistant and non-child resistant modes.

16. The cap of claim 14, wherein:

the cap stop device is positioned proximate the bottom outer opening edge to engage the container stop device when the cap is in the child resistant mode to limit rotational movement of the cap relative to the container in a direction of removal of the cap from the container; and the engagement between the container side of the inner section top and the container opening edge limits the rotational movement of the cap relative to the container in a direction of attachment of the cap to the container.

17. The cap of claim 14, the at least one connector including a plurality of connectors positioned to radially space the inner section from the outer section, define a gap between the inner section and the outer section, and separate the inner section and the outer section by a radial distance, each connector including a connector length wherein the radial distance is less than the connector length.

18. The cap of claim 17, wherein the plurality of connectors are flexibly attached to the inner section and the outer section and are positioned to releasably inhibit axial movement of the inner section relative to the outer section between the child resistant and non-child resistant modes.

19. The cap of claim 14, wherein:

the inner section top is positioned substantially planer with the top outer opening edge when the cap is in the child resistant mode; and the inner section bottom is positioned substantially planer with the bottom outer opening edge when the cap is in the non-child resistant mode.

20. The cap of claim 14, wherein the at least one connector includes at least one aperture circumferentially aligned with each cap stop device.

21. A convertible closure and container pharmaceutical system, the system comprising:

a container including a container axis and a neck, the neck having a container stop device, container engaging device, and a container opening edge defining a container opening; and a one piece convertible closure having a child resistant mode when applied to the container in a child resistant configuration and having a non-child resistant mode when applied to the container in a non-child resistant configuration, the one piece convertible closure including:

a closure axis about which the closure is rotatable;

an outer section having an outer circumferential side wall including a first inner surface, a first outer surface, and a closure stop device, the outer circumferential side wall defining a top outer opening edge and a bottom outer opening edge, the closure stop device positioned on the inner surface and engaging the container stop device when the one piece convertible closure is in the child resistant mode to limit rotational movement of the one piece convertible closure relative to the container in a direction of removal of the one piece convertible closure from the container;

an inner section including an inner section top, an inner section bottom, and an inner circumferential side wall extending from the inner section top, the inner section top including a container side positioned to engage the container opening edge and limit the axial and rotational movement of the one piece convertible closure relative to the container in a direction of attachment of the one piece convertible closure to the container when the one piece convertible closure is secured to the container, the inner circumferential side wall including a second inner surface and a second outer surface, the second inner surface having a closure engaging device for engagement with the container engaging device;

a plurality of armatures integrally formed with the inner and outer sections and flexibly attached to the inner and outer sections, the armatures attaching the inner section to the outer section; and the inner section being coaxially positioned within the outer section and axially movable relative to the outer section between a child resistant configuration and a non-child resistant configuration to convert the one piece convertible closure from a child resistant mode to a non-child resistant mode, the plurality of armatures, inner section and outer section being dimensioned and positioned to releaseably maintain the inner and outer sections in the non-child resistant position and to releaseably maintain the inner and outer sections in the child resistant position.

22. The system of claim 21, wherein:

the plurality of armatures are positioned to radially space the inner section from the outer section to, define a gap between the inner section and the outer section, and separate the inner section and the outer section by a radial distance;

each armature includes an armature length; and the radial distance is less than the armature length.

23. The system of claim 21, wherein:

the inner section top is positioned substantially planer with the top outer opening edge when the one piece convertible closure is in the child resistant mode; and the inner section bottom is positioned substantially planer with the bottom outer opening edge when the one piece convertible closure is in the non-child resistant mode.

24. A convertible closure and container pharmaceutical system, the system comprising:

a container including a container axis and a neck, the neck having a container stop device, container engaging device, and a container opening edge defining a container opening; and a one piece convertible closure having a child resistant mode when applied to the container in a child resistant configuration and having a non-child resistant mode when applied to the container in a non-child resistant configuration, the one piece convertible closure including:

a closure axis about which the closure is rotatable;

an outer section having an outer circumferential side wall including a first inner surface, a first outer surface, and a closure stop device, the outer circumferential side wall defining a top outer opening edge and a bottom outer opening edge, the closure stop device positioned on the inner surface and engaging the container stop device when the one piece convertible closure is in the child resistant mode to limit rotational movement of the one piece convertible closure relative to the container in a direction of removal of the one piece convertible closure from the container;

an inner section including an inner section top, an inner section bottom, and an inner circumferential side wall extending from the inner section top, the inner section top including a container side positioned to engage the container opening edge and limit the axial and rotational movement of the one piece convertible closure relative to the container in a direction of attachment of the one piece convertible closure to the container when the one piece convertible closure is secured to the container, the inner circumferential side wall including a second inner surface and a second outer surface, the second inner surface having a closure engaging device for engagement with the container engaging device;

a plurality of armatures integrally formed with the inner and outer sections and flexibly attached to the inner and outer sections, the armatures attaching the inner section to the outer section;

the inner section being coaxially positioned within the outer section and axially movable relative to the outer section between a child resistant configuration and a non-child resistant configuration to convert the one piece convertible closure from a child resistant mode to a non-child resistant mode;

and wherein the inner section top is positioned substantially planer with the top outer opening edge when the one piece convertible closure is in the child resistant mode, and the inner section bottom is positioned substantially planer with the bottom outer opening edge when the one piece convertible closure is in the non-child resistant mode.

25. A convertible closure and container pharmaceutical system, the system comprising:

a container including a container axis and a neck, the neck having a container stop device, container engaging device, and a container opening edge defining a container opening; and a one piece convertible closure having a child resistant mode when applied to the container in a maintainable child resistant configuration and having a non-child resistant mode when applied to the container in a maintainable non-child resistant configuration, the one piece convertible closure including:

a closure axis about which the closure is rotatable;

an outer section having an outer circumferential side wall including a first inner surface, a first outer surface, and a closure stop device, the outer circumferential side wall defining a top outer opening edge and a bottom outer opening edge, the closure stop device positioned on the inner surface and engaging the container stop device when the one piece convertible closure is in the child resistant mode to limit rotational movement of the one piece convertible closure relative to the container in a direction of removal of the one piece convertible closure from the container;

an inner section including an inner section top, an inner section bottom, and an inner circumferential side wall extending from the inner section top, the inner section top including a container side positioned to engage the container opening edge and limit the axial and rotational movement of the one piece convertible closure relative to the container in a direction of attachment of the one piece convertible closure to the container when the one piece convertible closure is secured to the container, the inner circumferential side wall including a second inner surface and a second outer surface, the second inner surface having a closure engaging device for engagement with the container engaging device;

a plurality of armatures integrally formed with the inner and outer sections and flexibly attached to the inner and outer sections, the armatures attaching the inner section to the outer section, the location of connection of the plurality of armatures to the outer section being higher than the location connection of the plurality of armatures to the inner section when the one piece convertible closure is in the non-child resistant mode and the location of connection of the plurality of armatures to the inner section being higher than the location connection of the plurality of armatures to the outer section when the one piece convertible closure is in the child resistant mode; and the inner section being coaxially positioned within the outer section and axially movable relative to the outer section between the maintainable child resistant configuration and the maintainable non-child resistant configuration to convert the one piece convertible closure from the child resistant mode to the non-child resistant mode.

* * * * *